United States Patent [19]

Costello

[11] Patent Number: 4,477,937

[45] Date of Patent: Oct. 23, 1984

[54] COMBINED PLIERS, CLAMP AND WRENCH

[76] Inventor: James Costello, 414 E. Smith St., Corry, Pa. 16407

[21] Appl. No.: 498,854

[22] Filed: May 27, 1983

[51] Int. Cl.[3] ..... B25F 1/04; B25B 13/52

[52] U.S. Cl. ..... 7/139; 81/5.1 R; 81/367; 81/68; 81/129

[58] Field of Search ..... 7/138, 139; 81/5.1 R, 81/367–380, 66 R, 67, 68, 129

[56] References Cited

U.S. PATENT DOCUMENTS

| | | | |
|---|---|---|---|
| 1,354,494 | 10/1920 | King | 81/373 |
| 2,042,137 | 5/1936 | Wilson | 81/68 |
| 2,519,630 | 8/1950 | Boyer | 81/373 |
| 2,630,035 | 3/1953 | Zazdrzyk | 81/372 |
| 2,906,154 | 9/1959 | Seppola | 81/68 |
| 3,192,804 | 7/1965 | Petersen et al. | 81/370 |

*Primary Examiner*—Roscoe V. Parker

*Attorney, Agent, or Firm*—Ralph Hammar

[57] ABSTRACT

A combined wrench, locking pliers and chain clamp using a toggle for the gripping and clamping functions.

3 Claims, 4 Drawing Figures

COMBINED PLIERS, CLAMP AND WRENCH

This invention is a multipurpose tool which performs the functions of pliers, wrenches and chain clamps.

Figure 1:
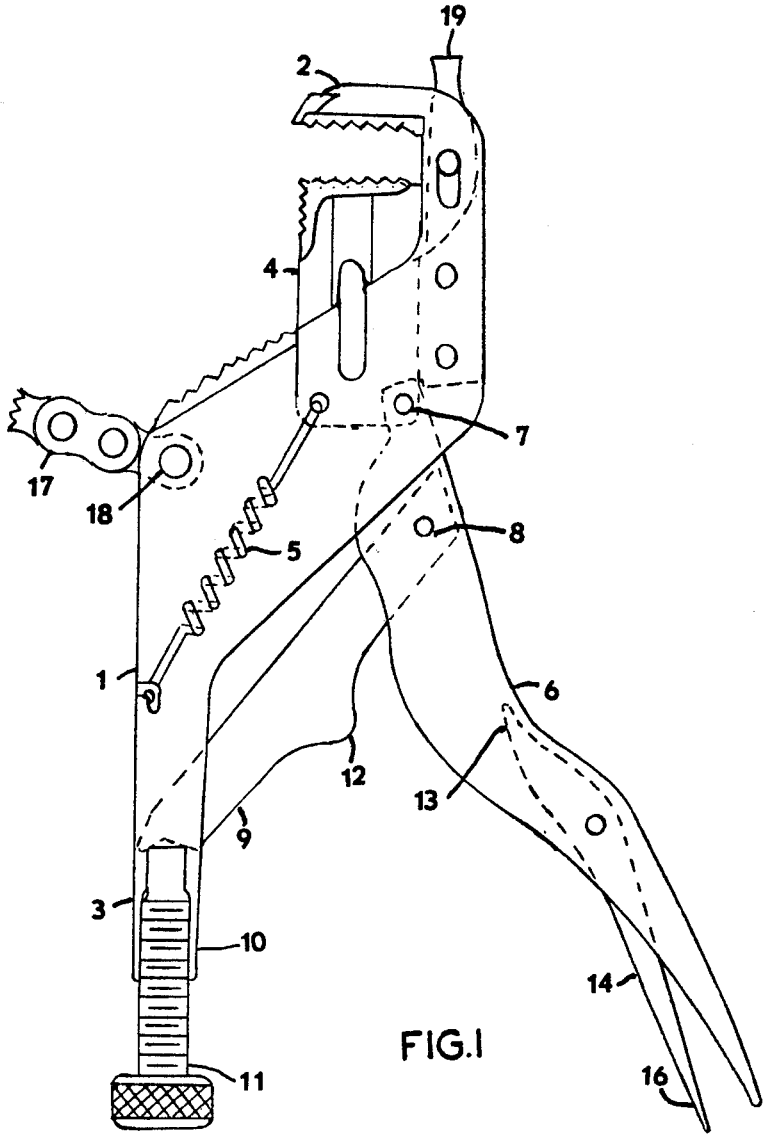
FIG. 1 is a side elevation showing the tool in the open position.

The tool has a frame 1 with a jaw 2 at one end and a handle 3 at the other end. Adjacent the jaw 2 is a reciprocable jaw 4 slidably mounted in the frame 1 and urged to the open or retracted position by a spring 5. The jaw 4 is moved toward and away from the jaw 2 by a handle 6 pivoted at 7 to the jaw 4 and pivoted at 8 to a toggle link 9 extending between the pivot 8 and an adjustable abutment 10 at the upper end of a screw 11 threaded into the lower end of the handle 3. As the handle 6 is squeezed toward the handle 3, the toggle link 9 is moved slightly past the dead center position in which a stop portion 12 on the toggle link engages the inner end 13 of a release lever 14 pivoted on the handle 6. The separation of the jaws 2 and 4 in the closed position is determined by the adjustment of the screw 11.

Figure 2:
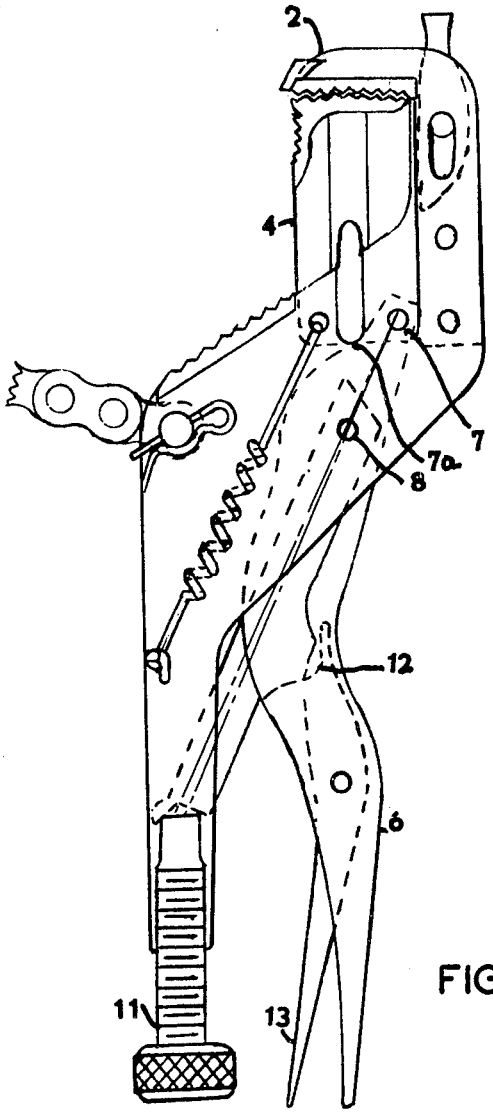
FIG. 2 is a view similar to FIG. 1 showing the jaws closed.

FIG. 2 shows the jaws 2 and 4 almost touching, a position suitable for clamping thin sheets of metal. By screwing the screw 11 outward, the jaws 2 and 4 can be further separated, a condition suitable for gripping thicker material, or for gripping a nut or bolt head. The clamping pressure is easily released by squeezing the outer end 16 of the release lever 14. Clamping pressure is applied to pivot 7 by the toggle and also by contact of point *7a* on the handle with the lower end of jaw 4 as shown in FIG. 2. FIG. 2 shows the outer end of the lever 19 projecting above the jaw 2. The lever 19 can be slidably mounted to allow it to be retracted or pushed back into the frame 1 if the protrusion is objectionable.

Figure 3:
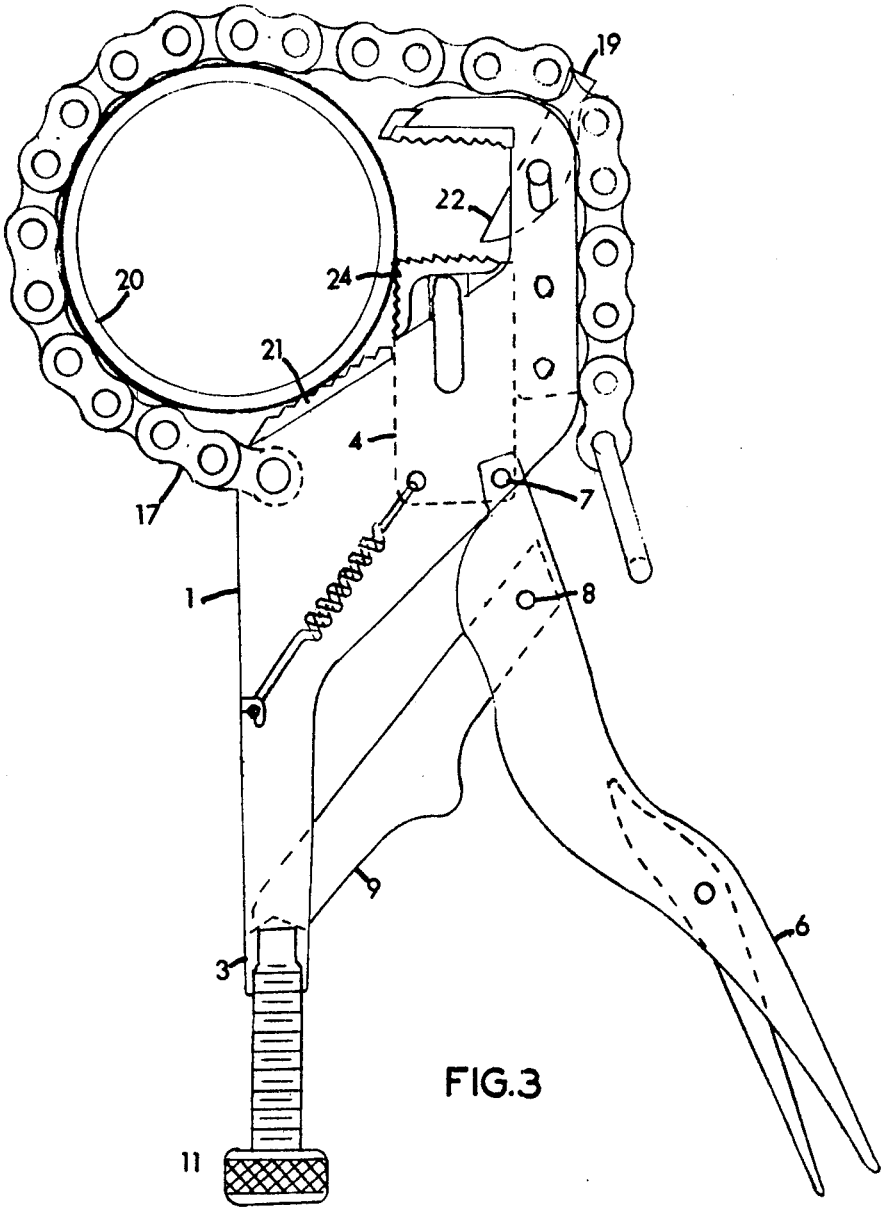
FIG. 3 shows the tool using the chain for clamping, the clamp being in a loose position.
Figure 4:
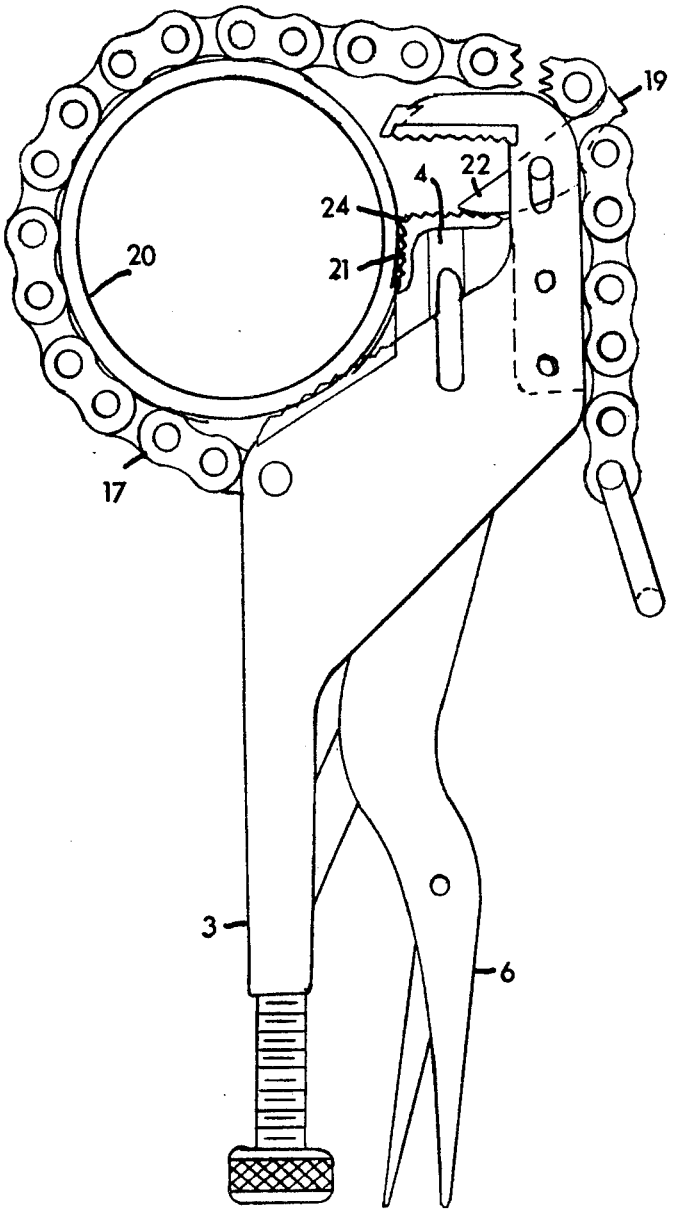
FIG. 4 is a view similar to FIG. 3 showing the clamp tightened.

When the tool is used for clamping by means of the jaws 2 and 4, a chain 17 having one end pinned to the member 1 at 18 may be removed if it is in the way. When the chain is to be used for clamping, the movable jaw 4 is retracted to the position shown in FIG. 3 where a lever 19 is moved from the position shown in FIG. 1 to the position shown in FIG. 3. In the FIG. 3 position, where the chain 17 is draped over a pipe 20 which is to be clamped against a serrated surface 21 on the member 1, the inner end 22 of the lever 19 projects over the jaw 4 and the outer end of the lever extends between two of the chain links. In this position, the chain is only finger tight over the pipe. As the hand grips 3 and 6 are squeezed, the toggle 7, 8, 9 forces the jaw 4 upward, causing the lever 19 to pivot in a clockwise direction about its pivot pin 23 and to thereby tighten the chain against the pipe. The pipe may also come into contact with the corner 24 of the jaw 4. By means of the toggle action, the chain can be pulled sufficiently tightly against the surface 21 so that slippage of the pipe relative to the chain is prevented. This allows the tool to be used as a pipe wrench or pipe clamp. The chain would also be satisfactory for clamping other bodies. Damage to surface finish by contact with the serrations can be prevented by the usual expedients.

When the chain is to be used as a clamp, the screw 11 will be adjusted to that the toggle 7, 8, 9 always goes over center in the clamping position. When the tool is to be used as a pipe wrench, the screw may be adjusted so that the toggle is stopped short of dead center and the force multiplication of the toggle is utilized to grip the pipe for turning and the release of the grip releases the gripping pressure because the toggle has not moved past dead center.

I claim:

1. A wrench comprising a first member having a first jaw at one end and a first hand grip at the other end, a second jaw between the ends of the first member slidably mounted on said first member for linear movement toward and away from the first jaw, a second member having at one end a first pivot to said second jaw and having a second hand grip at its other end, a toggle link extending from an adjustable abutment between the ends of the first member to a second pivot on the second member, said toggle link and said second member forming a toggle between said abutment and said second jaw for moving said second jaw toward said first jaw as the hand grips are squeezed, a workpiece supporting surface on said first member, a chain having one end anchored to the first member and its other end extending over a workpiece on said surface, and means for transferring force from said second jaw to the other end of the chain for tightening the chain against said workpiece.

2. The structure of claim 1 in which the means for transferring force from the second jaw to the chain is a lever pivoted on the first member and actuated by movement of said second jaw.

3. The structure of claim 2 in which the lever has one end in the path of movement of the second jaw toward the first jaw and the lever has the other end hooked in force transferring relation to said other end of the chain.

* * * * *